US005151205A

United States Patent [19]

Culpon, Jr.

[11] Patent Number: 5,151,205

[45] Date of Patent: Sep. 29, 1992

[54] CHAIN AND DRIVE GEAR LUBRICANT

[75] Inventor: Douglas H. Culpon, Jr., Port Neches, Tex.

[73] Assignee: Texaco Inc., White Plains, N.Y.

[21] Appl. No.: 698,870

[22] Filed: May 13, 1991

[51] Int. Cl.[5] ..... C10M 129/68

[52] U.S. Cl. ..... 252/56 R; 252/50; 252/51.5 R; 252/51.5 A

[58] Field of Search ..... 252/56 R, 50

[56] References Cited

U.S. PATENT DOCUMENTS 4,061,581 12/1977 Leleu ..... 252/32.7 E
4,175,046 11/1979 Coant et al. ..... 585/3
4,655,947 4/1987 Tsai et al. ..... 252/56 R
4,857,220 8/1989 Hashimoto ..... 252/56 R
4,908,146 3/1990 Smith, Jr. ..... 252/56 R

FOREIGN PATENT DOCUMENTS 103884 3/1984 European Pat. Off. ..... 252/56 R

*Primary Examiner*—Ellen McAvoy
*Attorney, Agent, or Firm*—Jack H. Park; Kenneth R. Priem; Richard A. Morgan

[57] ABSTRACT

A lubricating composition has been found for chain and gear drive mechanisms. The composition comprises a polyalphaolefin base oil, an ester oil solubilizer and 2 to 4 wt % of a polybutene tackifier. The composition replaces a mineral oil formulation and demonstrates persistent lubricity and substantially reduced smoking in chain and drive gear assemblies operated at high temperatures.

17 Claims, No Drawings

CHAIN AND DRIVE GEAR LUBRICANT

BACKGROUND OF THE INVENTION

1. Field Of The Invention

The invention relates to a lubricating composition comprising a synthetic base oil, a solubilizer and a tackifier comprising a polybutene polymer.

2. Description Of Other Related Methods In The Field

Open chain and drive gear assemblies require a lubricant which clings to the moving contacting surfaces and provides lubrication and anti-wear protection. A variety of lubricant compositions can be used for these assemblies operating at low temperatures. Machinery assemblies operating at high temperature require similar lubrication and anti-wear protection. Additionally the lubricant must withstand the high temperature or decompose harmlessly, e.g. decompose without forming deposits or unacceptable amounts of smoke. Examples of high temperature chain and drive gear assemblies include those associated with ovens, furnaces, kilns and other hot equipment. These chain and drive gear assemblies are used in textile plants, heavy manufacturing, light manufacturing, wall board manufacturing, corrugated metal plants, paper mills and other manufacturing facilities.

SUMMARY OF THE INVENTION

The invention is a lubricating oil composition comprising a synthetic base oil, solubilizer and a tackifier. The solubilizer comprises a solubilizing amount of an ester oil. The tackifier comprises 2 to 4 wt % of a polybutene polymer of average molecular weight 100,000 to 1,000,000.

This composition has been found to provide persistent lubricity to open chain and drive gear assemblies.

DESCRIPTION OF THE PREFERRED EMBODIMENTS

Chain and gear drive lubricants must lubricate the contacting surfaces of the chain and gears as well as protect them from wear. It is desirable that the lubricant distribute uniformly over metal surfaces to protect the entire assembly from rust and oxidation. Counter to this distributive property is the desirability that the lubricant be persistent without the need for continuing technician attention. All of these requirements are more difficult to achieve in high temperature environments. Finally, it is desirable under these high temperatures or high to ambient temperature cycles that the degradation products not be harmful to the metal surfaces, particularly contact surfaces and that the lubricant not evolve appreciable amounts of smoke.

It has been found that synthetic base lubricating oils are useful for chain and drive gear assemblies because their decomposition products are free of deposits and evolve lower amounts of smoke on high temperature degradation than mineral oils.

Synthetic base lubricating oils may include polyalphaolefin (PAO) oils, ester (diester and polyolester oils), polyalkylene glycol oils or mixtures having a kinematic viscosity of 4 cSt to 100 cSt at 100° C. These synthetic base oils are inherently free of sulfur, phosphorus and metals and produce less obnoxious smoke.

Polyalphaolefin oils are prepared by the oligomerization of 1-decene or other lower olefin to produce high viscosity index lubricant range hydrocarbons in the $C_{20}$ to $C_{60}$ range. Other lower olefin polymers include polypropylene, polybutylenes, propylene-butylene copolymers, chlorinated polybutylenes, poly(1-hexenes), poly(1-octenes), alkylbenzenes (e.g., dodecylbenzenes, tetradecylbenzenes, dinonylbenzenes, di(2-ethylhexyl)-benzenes); polyphenyls (e.g., biphenyls, terphenyls, alkylated polyphenols); and alkylated diphenyl ethers and alkylated diphenyl sulfides and the derivatives, analogs and homologs thereof.

Polyalkyleneglycol oils are prepared by polymerization of alkylene oxide polymers and interpolymers and derivatives wherein the terminal hydroxyl groups have been modified by esterification, etherification, etc. Examples include polyoxyalkylene polymers prepared by polymerization of ethylene oxide or propylene oxide, the alkyl and aryl ethers of these polyoxyalkylene polymers (e.g., methyl-polyisopropylene glycol ether having an average molecular weight of 1000, diphenyl ether of poly-ethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

The ester oil serves as the solubilizing medium between the synthetic lubricating base oil and the tackifier and any other additives. Ester oil may comprise an aliphatic diester of an aliphatic dicarboxylic acid. These include esters of phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl)-sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting 1 mole of sebacic acid with two moles of tetraethylene glycol and 2 moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Tackifier causes the lubricant to cling to open surfaces. Treat rate of this material was optimized to accommodate customer preference. An insufficient tackifier level causes the lubricant to drip excessively from moving chains and rotating open gears and poor lubrication results in wear in downstream parts. An excessive tackifier level causes a stringy product that is difficult to apply. Testing with slideway lubricants showed that less than 2% tackifier was insufficient and field testing showed that more than 4% tackifier was difficult to apply.

The additive composition may include an antioxidant comprising a phenolic antioxidant, an amino antioxidant and mixtures thereof.

Phenols which are useful for this purpose include various alkylated phenols, hindered phenols and phenol derivatives such as t-butyl hydroquinone, butylated hydroxyanisole, polybutylated bisphenol A, butylated hydroxy toluene, alkylated hydroquinone, 2,5-ditertaryl hydroquinone 2,6-ditert-butyl-para-cresol, 2,2,'-methylenebis(6-tert-butyl-p-cresol); 1,5-naphthalenediol; 4,4,'-thiobis(t-tert-butyl-m-cresol); p,p-biphenol; butylated hydroxy toluene; 4,4,'-butylidenebis(6-tert-butyl-m-cresol); 4-methoxy-2,6-di-tert-butyl phenol; and the like.

Amino antioxidants include aldehyde amines, ketone amines, ketone-diarylamines, alkylated diphenylamines, phenylenediamines and the phenolic amines.

The additive composition may include a rust inhibitor/metal passivator. These are selected from triazole derivatives and alkenyl succinic acid esters which are known for this purpose.

Triazole derivatives are the reaction product of a substantially aliphatic, substantially saturated hydrocarbon substituted carboxylic acid wherein the hydrocarbon group contains at least about 20 aliphatic carbons, with an aminoguanidine derivative of the formula:

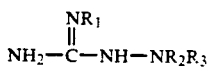

wherein $R_1$ is hydrogen or a $C_1$ to $C_{15}$ hydrocarbyl radical, and $R_2$ and $R_3$ are independently hydrogen or a $C_1$ to $C_{20}$ hydrocarbyl radical, or salts thereof. Reaction is with reactants and under conditions to form a hydrocarbon substituted 1,2,4-triazole, preferably the 1,2,4-triazole-3-amine.

Suitable triazoles include tolyltriazole, benzotriazole and aminotriazole.

The alkenyl succinic acid or anhydride structural unit employable in the instant invention is represented by the formula:

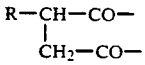

in which R is an alkenyl group having from 10 to 35 carbon atoms. Preferably R is an alkenyl group having 12 to 25 carbon atoms and more preferably an alkenyl group of 14 to 20 carbon atoms. Examples of suitable alkenyl groups include decenyl, dodecenyl, tetradecenyl, octadecenyl and tricosenyl. For the purposes of this invention the alkenyl succinic acid and the alkenyl succinic anhydride function as reaction equivalents, that is, the same products are formed with either the acid or anhydride reactant.

Either one or both of the carboxyl functionalities is esterified, preferably with an amino alcohol represented by the formula $$H_2N(CH_2)_nOH$$

in which n is an integer from 2 to 6. Preferably n is an integer from 2 to 5 and more preferably an integer from 2 to 3. Examples of suitable alkanolamine reactants are monoethanolamine, 1,2-propanolamine, 1,3-propanolamine, 1,2-butanolamine, 1,3-butanolamine and 1,4-butanolamine.

Examples of succinamic acid products are
N-(2-hydroxyethyl)-n-tetradecenyl succinamic acid,
N-(3-hydroxypropyl)-n-tetradecenyl succinamic acid,
N-(2-hydroxypropyl)-n-tetradecenyl succinamic acid,
N-(4-hydroxybutyl)-n-dodecenyl succinamic acid,
N-(3-hydroxybutyl)-n-octadecenyl succinamic acid,
N-(2-hydroxybutyl)-n-dodecenyl succinamic acid,
N-(2-hydroxyethyl)-n-decenyl succinamic acid, and
N-(2-hydroxyethyl)-n-octadecenyl succinamic acid.

Examples of the succinimide products are
N-(2-hydroxyethyl)-n-tetradecenyl succinimide,
N-(2-hydroxypropyl)-n-tetradecenyl succinimide,
N-(3-hydroxypropyl)-n-tetradecenyl succinimide,
N-(4-hydroxybutyl)-n-dodecenyl succinimide,
N-(2-hydroxybutyl)-n-octadecenyl succinimide,
N-(2-hydroxyethyl)-n-octadecenyl succinimide, and
N-(2-hydroxyalkyl)-n-tricosenyl succinimide.

Examples of succinamide products are
N,N'-di(2-hydroxyethyl)-n-tetradecenyl succinamide,
N,N'-di(2-hydroxypropyl)-n-tetradecenyl succinamide,
N,N'-di(2-hydroxypropyl)-n-tetradecenyl succinamide,
N,N'-(3-hydroxypropyl)-n-tetradecenyl succinamide,
N,N'-di(4-hydroxybutyl)-n-dodecenyl succinamide, and
N,N'-di(2-hydroxybutyl)-n-octadecenyl succinamide.

The alkenyl succinic acid (anhydride) and alkanolamine reaction products are described in U.S. Pat. No. 4,505,832 to Whiteman et al. incorporated herein by reference.

The lubricating compositions are formulated by methods well-known in the art. That is, the formulation is carried out continuously at the cannery. In the alternative, the compositions can be formulated in a semi works by hand. The base oil and ester oil are weighed and added to a steam jacketed stainless steel kettle at ambient temperature to 150° F., with stirring. Additives are weighed and added. When a homogeneous mixture is achieved, the tackifier is then added gradually, with continuous stirring. This composition is canned and shipped to point of use.

The oil pan of a chain and drive gear assembly is drained, flushed and then refilled with the lubricating oil composition of the invention. The chain and gears are wiped clean of oil and deposits with a clean, lint free cotton cloth. Fresh lubricating composition is brushed or sprayed lightly on the chain. The chain and drive gear are restarted.

This invention is shown by way of example.

EXAMPLE 1

Six lubricant compositions were formulated and tested in the laboratory.

TABLE 1

| | Composition | | |
|---|---|---|---|
| | 1 | 2 | 3 |
| Base Oil | 74.2 wt % | 75.2 wt % | 73.2 wt % |
| TMP Ester 1 | 20.0 | 20.0 | — |
| TMP Ester 2 | — | — | 22.0 |
| Tackifier | 4.0 | 3.0 | 3.0 |
| Gear Oil Additives | 1.5 | 1.5 | 1.5 |
| Antioxidant 1 | 0.3 | 0.3 | 0.3 |
| Blue dye | 40 ppm | 40 ppm | 40 ppm |
| LABORATORY TEST | | | |
| Viscosity, cSt @ 40° C. | 306.8 | 298.9 | — |
| Viscosity, cSt @ 100° C. | 35.4 | 35.0 | — |
| Viscosity Index | 162 | 163 | — |
| Flash Point, COC, °F. | 410 | 445 | 430 |
| Rotary Bomb Oxidation Test, min. | 360 | 240 | 270 |
| Timken OK Load, pounds | 75 | 65 | — |
| Load Wear Index | 77 | 55 | 54 |
| Weld Point, kg | 250 | 250 | 315 |
| 4-ball Wear 54° C./1800 rpm/20 kg | 0.38 | 0.31 | 0.34 |
| 4-ball Wear 54° C./1800 rpm/20 kg | 0.37 | 0.33 | 0.34 |

TABLE 2

| | Composition | | |
|---|---|---|---|
| | 4 | 5 | 6 |
| Base Oil | 72.4 wt % | 73.2 wt % | 73.0 wt % |
| TMP Ester 1 | 21.8 | 22.0 | 22.0 |
| Tackifier | 3.0 | 3.0 | 3.0 |
| Gear Oil Additives | 1.5 | 1.5 | 1.5 |
| Antioxidant 1 | 0.3 | — | — |
| Antioxidant 2 | — | 0.3 | 0.45 |
| Antioxidant 3 | 0.7 | — | — |
| Antioxidant 4 | 0.3 | — | — |
| Rust Inhibiter | — | — | — |
| Blue dye | 40 ppm | 40 ppm | 40 ppm |
| LABORATORY TEST | | | |
| Viscosity, cSt @ 40° C. | 306.8 | 298.9 | — |
| Viscosity, cSt @ 40° C. | 318.8 | 317.1 | 318.2 |
| Viscosity, cSt @ 100° C. | 36.0 | 29.6 | 31.5 |
| Viscosity Index | 160 | 128 | 138 |
| Flash Point, COC, °F. | — | 445 | — |
| Rotary Bomb Oxidation Test, min. | 170 | 172 | 265 |
| Timken OK Load, pounds | 65 | — | — |
| Load Wear Index | 69 | — | — |
| Weld Point, kg | 315 | — | — |
| 4-ball Wear 54° C./1800 rpm/20 kg | 0.42 | — | — |
| 4-ball Wear 54° C./1800 rpm/20 kg | 0.42 | — | — |

TABLE OF COMPONENTS

| | |
|---|---|
| Base fluid | polyalphaolefins 40 to 100 cSt @ 100° C. |
| TMP ester 1 | trimethylol propane ester of $C_8$–$C_{10}$ normal carboxylic acids. |
| TMP ester 2 | trimethylol propane ester of $C_7$ and $C_9$ normal carboxylic acids. |
| Tackifier | IDATAC ® M-256, polybutene polymer of 100,000 to 1,000,000 molecular weight. |
| Additives | sulfur and phosphorus antiwear and extreme pressure gear oil additive package. |
| Antioxidant 1 | ethylalphamethylsteryl phenylamine |
| Antioxidant 2 | octylbutylphenylamine |
| Antioxidant 3 | methylene bisdibutyldithiocarbamate |
| Antioxidant 4 | phenolic additive |

TABLE OF TEST METHODS

| | |
|---|---|
| 4-ball Wear | ASTM D-2266 |
| Rotary Bomb Oxidation Test | ASTM D-2272 |
| Timken OK Load | ASTM D-2782 |
| Load Wear Index | ASTM D-2783 |
| Weld Point | ASTM D-2783 |
| Flash Point, COC | ASTM D-92 |

TABLE 3

Vapor Pressure by Isoteniscope

| | Composition | | |
|---|---|---|---|
| Temperature | 1 | 2 | 3 |
| 150° F. | 0.1 torr | — torr | 0.13 torr |
| 175 | — | 0.11 | — |
| 200 | 0.31 | 0.2 | 0.43 |
| 250 | 0.83 | 0.53 | 1.2 |
| 300 | 2.0 | 1.3 | 2.9 |
| 350 | 4.4 | 2.9 | 6.4 |
| 400 | 8.6 | 5.4 | 12.5 |
| 450 | 16 | 10 | 33 |
| 500 | 58 | 28 | 135 |
| 550 | 330 | 190 | 800 |
| 575 | 680 | 430 | — |
| Initial decomposition Temperature | 461° F. | 438° F. | 449° F. |

TABLE 3-continued

Vapor Pressure by Isoteniscope

| | Composition | |
|---|---|---|
| Temperature | 4 | 5 |
| 150° F. | — torr | 0.12 torr |
| 175 | 0.14 | — |
| 200 | 0.27 | 0.4 |
| 250 | 0.78 | 1.1 |
| 300 | 2.0 | 2.6 |
| 350 | 4.7 | 5.7 |
| 400 | 9.6 | 12 |
| 450 | 23 | 36 |
| 500 | 95 | 160 |
| 550 | 570 | 470 |
| Initial decomposition Temperature | 456° F. | 450° F. |

| | Composition | |
|---|---|---|
| Temperature | 6 | Mineral Oil |
| 150° F. | 0.15 torr | — torr |
| 200 | 0.48 | — |
| 250 | 1.3 | 0.15 |
| 300 | 3.2 | 0.57 |
| 350 | 7.2 | 1.9 |
| 400 | 14.5 | 5.4 |
| 450 | 30 | 12.5 |
| 500 | 125 | 80 |
| 550 | 340 | 500 |
| 600 | 900 | — |
| Initial decomposition Temperature | 514° F. | 466° F. |

Mineral Oil - Meropa 320

EXAMPLE 2

A 1000 ft, 2 inch chain was lubricated by contact with a lubricant moistened pad. The chain passed at 3 ft/minute through a wall board drying oven and was subjected to temperatures of 260° F. to 520° F.

Adequate lubricant addition rate was determined by observing the presence of lubricant remaining on the returning chain, a dry chain indicating the absence of lubricant.

In a comparative test the lubrication rate to the lubricant application pad was measured. The rate was incrementally reduced until the returning chain was observed to be dry.

It was found that 5 gallons/day of a commercial synthetic base oil chain lubricant was required to keep the returning chain moist. Each of the six lubricating compositions of Example 1 was found to keep the returning chain moist at an application rate of about 1 gallon/day. Each of the six lubricants remained clear and free of significant deposits on the chain.

EXAMPLE 3

In a second field test, composition 2 was used to replace a commercial lubricant on a chain and drive gear assembly in machinery which formed corrugated metal. The commercial, mineral oil based lubricant produced large quantities of visible, blue smoke in this use. Composition 2 did not produce observable smoke in this machinery.

BEST MODE

As a result of Examples 2 and 3, Composition 2 is the Best Mode contemplated by inventor at the time of filing this application for lubricating high temperature chain and drive gear assemblies.

While particular embodiments of the invention have been described, it will be understood, of course, that the invention is not limited thereto since many modifications may be made, and it is, therefore, contemplated to cover by the appended claims any such modification as fall within the true spirit and scope of the invention.

What is claimed is:

1. A lubricating oil composition comprising:

a major portion of a synthetic base lubricating oil, a solubilizer comprising a trimethylol propane ester of $C_6$ to $C_{12}$ carboxylic acids; and 2 to 4 wt % of a tackifier comprising a polybutene polymer of molecular weight 100,000 to 1,000,000.

2. The lubricating oil composition of claim 1 wherein the solubilizer comprises 5 to 30 wt %.

3. The lubricating oil composition of claim 1 wherein the solubilizer comprises 15 to 25 wt %.

4. The lubricating oil composition of claim 1 wherein the solubilizer comprises an ester of a normal carboxylic acid.

5. The lubricating oil composition of claim 1 wherein the solubilizer comprises a trimethylolpropane ester of a mixture of normal $C_7$ to $C_{10}$ carboxylic acids.

6. The lubricating oil composition of claim 1 wherein the synthetic base oil comprises a polyalphaolefin of kinematic viscosity 4 to 100 cSt at 100° C.

7. The lubricating oil composition of claim 1 additionally comprising a phenolic antioxidant.

8. The lubricating oil composition of claim 1 additionally composing an amino antioxidant.

9. A lubricating oil composition comprising:

a major portion of polyalphaolefin oil of kinematic viscosity 4 to 100 cSt at 100° C., about 20 to 25 wt % of a trimethylolpropane ester of $C_7$ to $C_{10}$ normal carboxylic acids, 2 to 4 wt % of a polybutene polymer of molecular weight 100,000 to 1000,000.

10. The lubricating oil composition of claim 9 additionally comprising a phenolic antioxidant.

11. The lubricating oil composition of claim 9 additionally comprising extreme pressure and antiwear additives.

12. A lubricating oil composition consisting essentially of:

a major portion of polyalphaolefin oil of kinematic viscosity 4 to 100 cSt at 100° C., about 20 to 25 wt % of a trimethylolpropane ester of $C_7$ to $C_{10}$ normal carboxylic acids, 2 to 4 wt % of a polybutene polymer of molecular weight 100,000 to 1,000,000.

13. The lubricating oil composition of claim 12 additionally comprising an amino antioxidant.

14. The lubricating oil composition of claim 12 additionally comprising extreme pressure and antiwear additives.

15. A lubricating oil composition comprising:

a major portion of polyalphaolefin oil of kinematic viscosity 4 to 100 cSt at 100° C. about 20 to 25 wt % of a trimethylolpropane ester of $C_7$ to $C_{10}$ normal carboxylic acids, 2 to 4 wt % of a polybutene polymer of molecular weight 100,000 to 1,000,000 in the absence of compounds which decompose to smoke.

16. The lubricating oil composition of claim 15 additionally comprising an amino antioxidant.

17. The lubricating oil composition of claim 15 additionally comprising extreme pressure and antiwear additives.

* * * * *